US005405044A

United States Patent [19]

Lee

[11] Patent Number: 5,405,044

[45] Date of Patent: Apr. 11, 1995

[54] DRUM TOP DRIER

[76] Inventor: Donald M. Lee, 92 S. Altamont Rd., Huntington, W. Va. 25701

[21] Appl. No.: 941,903

[22] Filed: Sep. 8, 1992

Related U.S. Application Data

[63] Continuation-in-part of Ser. No. 571,721, Aug. 24, 1990, abandoned.

[51] Int. Cl.[6] ..... B65D 25/00; F26B 3/00

[52] U.S. Cl. ..... 220/694; 220/729; 220/DIG. 6; 34/335

[58] Field of Search ..... 220/200, 716, 729, DIG. 6, 220/694; 210/242.4, 924, 689; 34/9, 95, 95.1, DIG. 1, 335; 40/306, 307

[56] References Cited

U.S. PATENT DOCUMENTS

| | | | |
|---|---|---|---|
| 645,138 | 3/1900 | Sleeper | 34/95 |
| 951,122 | 3/1910 | Horn . | |
| 1,413,907 | 4/1922 | Gerstenberger | 220/DIG. 6 X |
| 1,434,155 | 10/1922 | Scherotto | 40/306 X |
| 1,652,907 | 12/1927 | Nelson et al. | 40/307 X |
| 1,935,192 | 11/1933 | Spahr | 15/244.1 |
| 2,101,565 | 12/1937 | Snelling | 40/307 |
| 2,226,793 | 12/1940 | Walters . | |
| 2,241,947 | 5/1941 | Goodwin | 34/95 X |
| 2,291,067 | 7/1942 | Atkins . | |
| 2,371,006 | 3/1945 | Weaver . | |
| 2,459,558 | 1/1949 | Villegas De Oribe | 220/716 |
| 2,693,685 | 11/1954 | Stafford | 220/716 |
| 2,810,145 | 10/1957 | Forrow | 15/244.1 X |
| 2,927,335 | 3/1960 | Hammond | 15/244.1 X |
| 3,182,393 | 5/1965 | Chevillon | 220/716 X |
| 4,126,556 | 11/1978 | Swanson et al. | 210/242.4 |

*Primary Examiner*—Gary E. Elkins
*Assistant Examiner*—Nova Stucker
*Attorney, Agent, or Firm*—Sidney W. Millard

[57] ABSTRACT

A layered combination of porous material mounted over the edge of a drum to siphon water from the top of the drum over the edge thereof.

20 Claims, 2 Drawing Sheets

FIG. 1
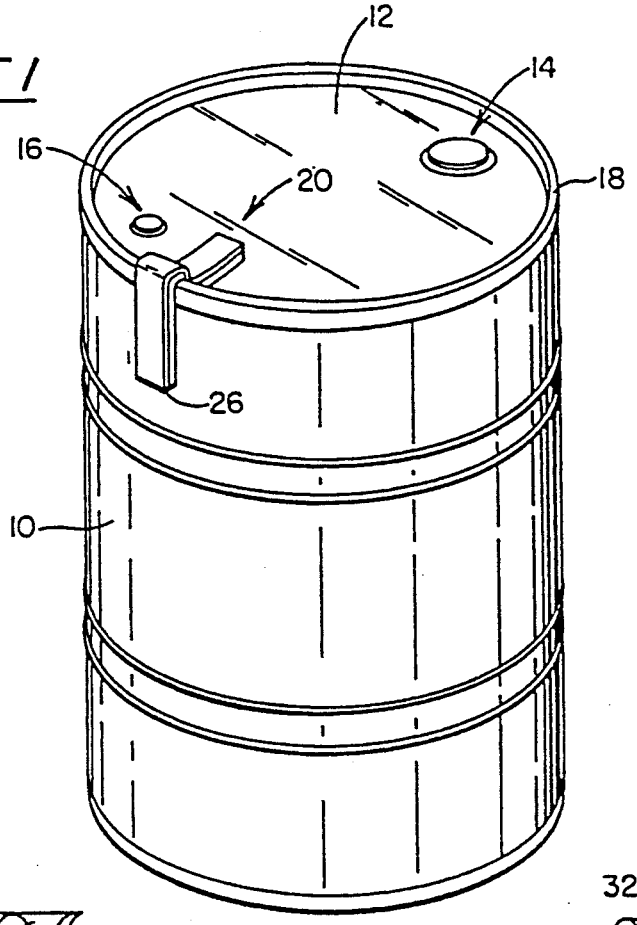
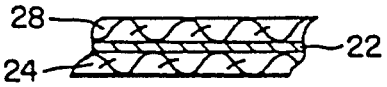
FIG. 3
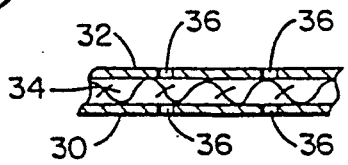
FIG. 4
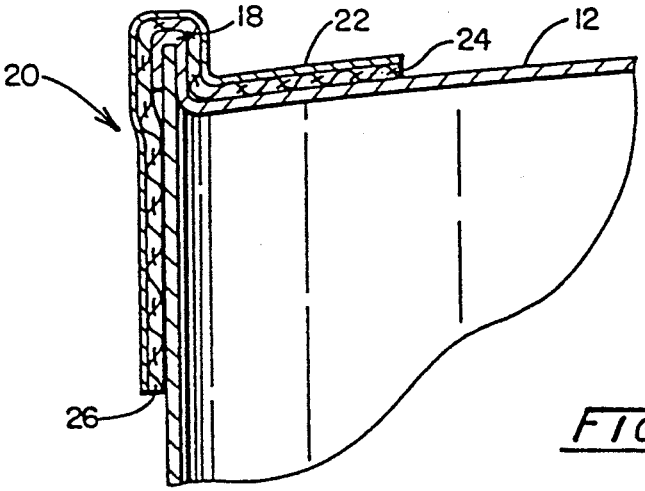
FIG. 2
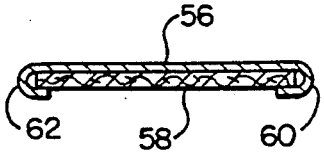
FIG. 9

DRUM TOP DRIER

REFERENCE TO OTHER APPLICATION

This application is a continuation-in-part of application Ser. No. 571,721, filed Aug. 24, 1990, now abandoned.

FIELD OF THE INVENTION

This apparatus is designed to be applied to the upper surface of a metallic storage drum stored on the outside of a building and subject to inclement weather. The apparatus is designed to drain liquids from the top of the drum over the rim and down the side to keep the top of the drum as dry as possible.

BACKGROUND OF THE INVENTION

The storage of bulk liquids in fifty-five gallon drums on the exterior of buildings is well-known. The drums might contain diesel fuel, pesticides, paint thinner or hundreds of other liquids. The problem is that when a painted metal drum is exposed to the elements for a sustained period of time, rust will begin to form in the cracks of the paint and the chipped areas. Ordinarily such drums are stored in the upright position and water will collect in the top depression, up to the level of the rim. The top of the drum and the rim form a shallow container where rain will collect and snow will settle and melt. The result is a wetting by precipitation and drying by sun evaporation in a sequential but non-uniform pattern.

Various remedies have been suggested for overcoming the problem of water collecting on the top of the drum. The first and most obvious solution is to store the drums on their sides and that is certainly satisfactory in some circumstances, but it will certainly take more time and it will certainly reduce the available storage space and increase the cost of apparatus for holding the drums in place. Obviously, a drum in the upright position is not going to move on a slightly inclined floor, but the same cannot be said for the cylindrical drum on its side.

There is another reason for storing the drums in upright position and it is the conventional practice today to move the filled drums by a fork lift which is designed to engage the upper rim of the barrel. Should the barrel be stored in horizontal position, the forklift engagement would not be possible. Using the forklift to transport filled drums by lying on their sides requires a pallet with wedges. The wedges would keep the drum from rolling off the pallet. The pallet is required to insure that the prongs of the lift do not accidentally puncture the drum side as they slide beneath the drum.

Another mechanism for keeping liquids from collecting in the top of the barrel is to apply a plastic lid over the top thereof. At the present time, the cost is $5.00 per barrel lid. In addition to the obvious problem of cost, the lid is easily broken, particularly in cold weather.

Neither of the suggested systems for maintaining water out of the barrel top is satisfactory, and accordingly, the invention described herein includes an inexpensive, easily applied, automatic siphon mechanism which may be applied to the top of the drum manually and reused with an additional drum if desirable.

BRIEF DESCRIPTION OF THE INVENTION

The invention includes a layered combination of porous material with another layer to secure the porous material to the top of a metallic drum. The porous material is a wick which draws water from the top of the drum by capillary action, upwardly and over the rim and down the side of the drum. The wick is a capillary forming material which may be laminated, bonded or otherwise mechanically attached to a stiffening material which is relatively rigid but manually deformable to allow it to be squeezed into a U-shape which will clamp the capillary forming material in place with a part adjacent the drumhead and a part extending down the side of the barrel. Alternative structure for securing the porous material in operative position include adhesive bonding, magnetic attachment, or the like.

Objects of the invention not clear from the above description will be fully understood by a review of the drawings and the description of the preferred embodiments which follow.

BRIEF DESCRIPTION OF THE DRAWINGS

FIG. 1 is a perspective view of a conventional fifty-five gallon drum having the liquid siphoning apparatus of this invention applied to the top thereof;

FIG. 2 is a fragmentary sectional view of the drum of FIG. 1 showing the siphoning apparatus;

FIG. 3 is a fragmentary sectional view of a different design of the siphoning apparatus of this invention;

FIG. 4 is yet another design of the siphoning apparatus of this invention;

FIG. 9 is a fragmentary sectional view of an alternative embodiment.

DESCRIPTION OF THE PREFERRED EMBODIMENTS

Figure 5:
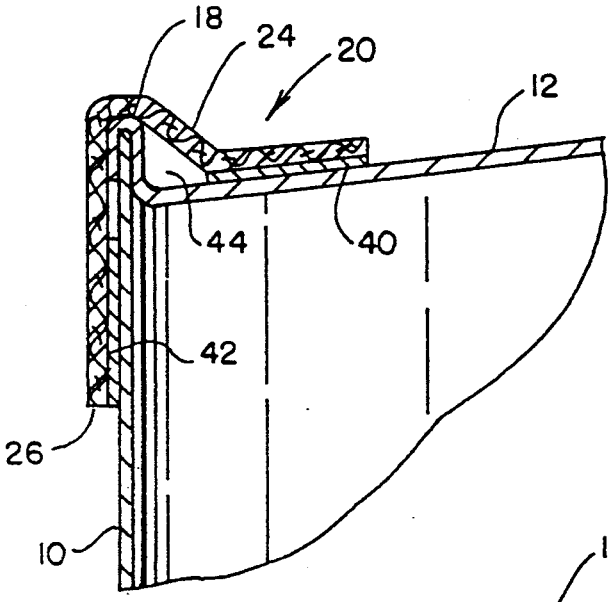
FIG. 5 is a fragmentary sectional view of an alternative embodiment of the siphoning apparatus.

Looking to FIG. 1, a fifty-five gallon drum 10 is shown in upright storage position with the top 12 having a dispensing opening 14 and a breather opening 16, both shown sealed with appropriate lids. It is not unusual to dispense liquids through opening 16. The way the contents are evacuated is not material to the invention.

Mounted on the rim or chime 18, at any particular location which seems desirable to the warehouseman who might be in charge of drum storage, is the siphoning apparatus 20 of this invention. Apparatus 20 serves to siphon water from the cavity formed by the top of the drum 12 and the rim 18 when rain, melted snow or the like has caused such liquid to collect.

FIG. 2 illustrates the basic concept which involves a layer of relatively rigid deformable material 22 bonded or otherwise mechanically attached to a felt like or woven wicking material 24 which serves to form capillary passageways for the liquid to be drained.

The preferred material for layer 22 is twenty gage galvanized steel which is about one to two inches wide and about twelve inches long. (It can be very short, so long as the lower end of wick is below the level of water on top of the drum.) Layer 22 is formed in a plannar structure and is sufficiently pliable and deformable as to be easily hand-squeezed into a sort of clamping action on the rim 12 by the hand strength of an ordinary warehouseman. The product may be preformed to fit the rim if desired. About three inches of the wicking material 24 is juxtaposed to the top 12 of the drum. If the apparatus 20 is strategically located in the slightly downhill side of a slightly tilted drum, all of the liquid on the top will drain toward the wick 24 since the top 12 of the drum is slightly domed, for reasons which have nothing to do with this invention. The horizontal portion of the wick may be short in length, it is only required that it touch the water to perform its draining function.

The wicking material 24 extends over the rim and down the side of the drum for a distance of about eight inches. Water collecting in the cavity on top of the drum is drawn by capillary action up through the wicking material 24, over the rim 18 and down the side where it drips from the lower end 26 of the wicking material.

As will be remembered from freshman college physics, capillary action occurs as a result of the surface tension in liquids. The height of the liquid rise in a capillary tube is based on the circumference of the tube, the surface tension of the particular liquid involved at that temperature and the relationship of the liquid to the tube material. The density of the liquid itself tends to pull the liquid column downward by gravity and when the weight of the liquid column exceeds the pull of the surface tension, the column of liquid becomes stationary. The reason the basic concept is mentioned is to emphasize the fact that the circumferential line of contact within the capillary tube overcomes a certain amount of gravitational pull regardless of whether the minuscus is formed on the downward side of an inverted U-shaped tube or on the upward side of a vertically extending tube. In other words, where the vertically extending tube extends into the liquid, the surface tension draws the liquid upward until the upward pull of the surface tension is counterbalanced by the mass of the liquid in the column being pulled downward by gravity. On the other hand, with a U-shaped inverted tube the downwardly extending branch of the U pulls the liquid downward by gravity and the surface tension is pulling the liquid column upward rather than downward. Given this theory, the invention will not work because the capillary will reach equilibrium and no water will flow. In fact, it does not work that way.

The reason a wick works where a glass capillary tube does not work is that the surface tension of the water tends to wet each fiber of a wick uniformly because the liquid migrates along the surface of the fibers of the wick rather than flowing like a liquid in a tube. Thereby, the circumference of each fiber of the wick becomes the length of the line upon which surface tension acts to pull the liquid along the fiber. After the wick is relatively uniformly wet, normal liquid flow theories come into play and the potential energy acts to drain the water downward outside the rim of the barrel. Gravity itself causes the water to drip from the lower end 26 of the wick.

As the above simplified explanation illustrates, the scientific principle of why wicks tend to become uniformly saturated does not lend itself to easy analysis and it is respectfully suggested that the reason this very simple appearing invention has not been previously adopted is because no one thought it would work until someone actually did it, namely, the inventor herein.

An alternative embodiment of the invention is illustrated in FIG. 3 wherein the metallic element 22 includes, in addition to the lower wicking material 24, an upper wick 28 which could serve as an additional passage for water and an enhanced draining power. Often wicks are woven as an elongated tube, cut to length; if desired the element 22 may slide into the woven tube.

Another alternative embodiment is illustrated in FIG. 4 and shows a metallic element 30 on the bottom and another metallic element 32 on the top. Sandwiched between the two metallic layers is a wicking material 34. Also illustrated in FIG. 4 is a perforated set of metallic surfaces, the apertures 36 serving to allow easier evaporation of water from the wick after the liquid has been drained from the drum top 12. Another feature to facilitate drying of the wick is to provide for the exposed surface of the deformable layer 22 to be black. The added heat drawn by the black surface facilitates evaporation.

Obviously, perforations 36 could be incorporated into the metallic layers 22 in FIGS. 2 and 3, if desired. The reason for this possibly desirable (perforation) feature is that the wet wick may tend to rust the surface of the barrel under the wick because the wick might retain water longer at that point. The perforations allow air to dry the wick more quickly and will not have any detrimental affect on the gripping power of the metallic surface around the rim 18. Should a rust spot and hole form immediately under the wick, water trapped on the drum top 12 tends to drain into the drum through the hole and, assuming water is heavier than the liquid within the container, the water will go to the bottom of the barrel and push the liquid therein out through the hole where it will be picked up by the wick and drained over the side. In fact, a similar thing happens now when a hole forms in the top of a drum where water has collected. The resulting leak and drainage when subsequent rains come can be a real pollution problem as the usual pollutants in the air combined with the contents of the drum brews a very corrosive broth.

While galvanized steel is a desirable clamping mechanism for the sandwich formed by the siphoning mechanism of this invention, aluminum or various kinds of deformable plastic may be used. As for the wicking material, paper towels have been used, a 50—50% blend of acrylic and cotton fiber conventional corduroy cloth has been used, non-woven 7.5 ounce per square yard of non-woven rayon material has been used and sixteen ounce filter felt has been used. The 50—50 blend and the non-woven rayon are preferred and the 50—50 blend is most preferred. In an experiment involving filter cloth one-eighth inch thick bonded to a twenty inch long galvanized steel strip; the strip was clamped to the edge of a barrel with the filter cloth side facing downwardly; a measurement of three fluid ounces per hour of drainage was observed. Using the non-woven rayon with the same galvanized steel strip twelve inches long and one-eighth inch thick rayon, a measurement of sixteen fluid ounces of drainage of water per hour was observed.

Based upon experiments conducted, greater flow rates occur where the wicking is wider and where it is longer down the side of the drum. Short narrow wicks work but long wider ones work much better.

The above description implies that the strengthening metallic layers 22, 30 and 32 are the same width as the wicking material. In fact, the strengthening material may be as narrow as a wire.

In another embodiment illustrated in FIG. 5 the wicking is bonded to a double sided adhesive tape 40, 42. Thus the wick is applied to a dry drum surface by merely stripping the peel strip from the adhesive and applying it to the drum top and sidewall by finger pressure. Perforations in the adhesive insure water contact with the wick or the adhesive may be a narrow strip which does not extend the full length or width of the wick 24 as illustrated in FIG. 5. The gap 44 between wick 24 and the drum top 22 at the rim 18 is not desirable for most effective operation. What is most desirable is for the wick to conform to the drum top and rim to maximize water contact with the wick.

The bonding material could be spots of double sided adhesive or magnets. The wick 24 performs its function when it is secured to the drum top 12 in contact with the water, the securing structure may assume various embodiments.

Figure 6:
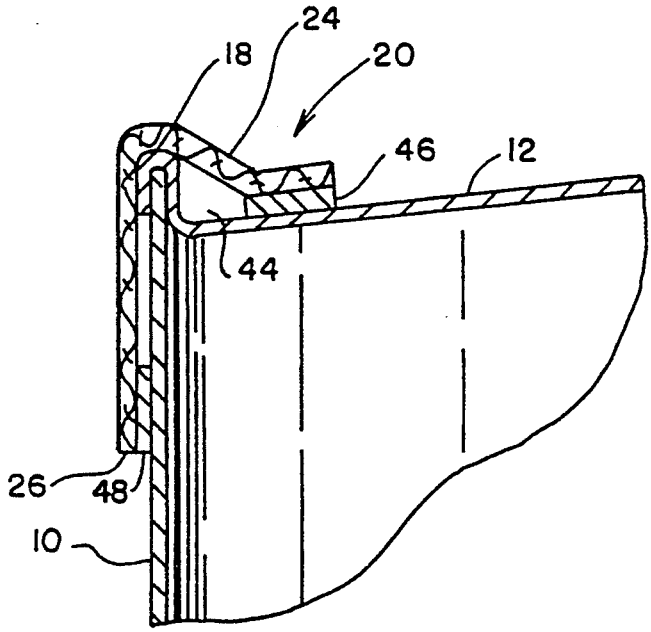
FIG. 6 is a fragmentary sectional view of another alternative embodiment of the siphoning apparatus.
Figure 7:
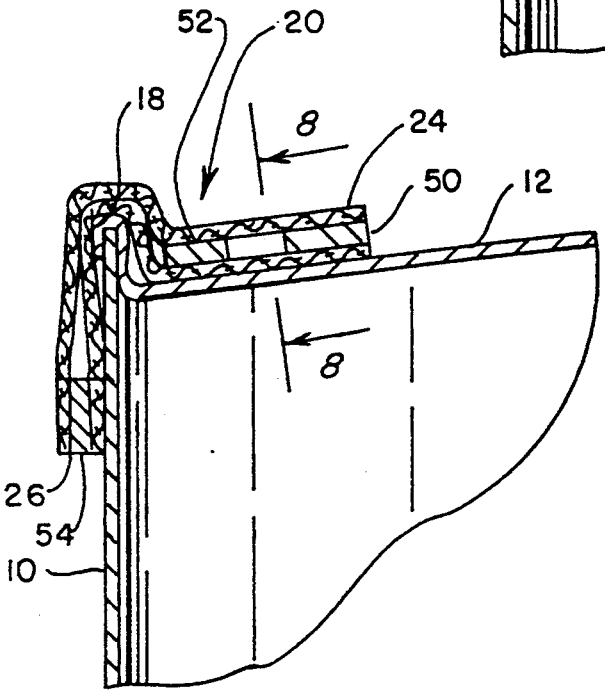
FIG. 7 is yet another fragmentary sectional view of an alternative embodiment of the siphoning apparatus.
Figure 8:
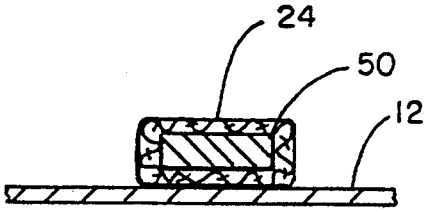
FIG. 8 is a fragmentary sectional view taken along line 8—8 of FIG. 7.

FIGS. 6–8 illustrate two embodiments which use magnets to adhere wick 24 in operative position. In FIG. 6 magnets 46, 48 are adhesively secured to wick 24 and are magnetically secured to the top 12 and side of drum 10. The thickness of magnet 46 is greatly exaggerated as is the thickness of adhesive layer 40 in FIG. 5.

FIGS. 7–8 illustrate a tubular wick 24 with two or more magnets 50, 52, 54 inserted into the tube to perform their function. With this latter embodiment the magnets 50, 52, 54 may be removed from the tube 24 when it gets old and inserted into a new tube.

FIG. 9 illustrates, in cross-section, an embodiment where the metal layer 56 serves as a shield for the wick 58 by having curled edges 60, 62. This allows the composite to pass over the rim 18 of a drum 10 but prevents the wick from being compressed in a way which may block the drainage capacity. For example, a cardboard box placed on the drum might stop water drainage in the embodiment of FIG. 2 but the embodiment of FIG. 9 will survive because of the strengthening edges 60, 62 which may prevent compression of the wick at the rim top.

Having thus described the invention in its preferred embodiments, it will be clear to those having ordinary skill in the art that modifications may be made in the apparatus without departing from the spirit of the invention. This may include a wick according to this invention which extends from inside a container of water or liquid fertilizer, over the edge and down to the soil to water or fertilize a growing plant. Accordingly, it is not intended that the drawings, nor the language used herein to describe the invention, be limiting on the invention itself, rather it is intended that the invention be limited only by the scope of the appended claims.

I claim:

1. The combination of a drum and apparatus for draining liquid from the top of said drum, comprising, said drum standing upright having a bottom, a sidewall, a top and an upwardly extending rim around said top, said rim extending circumferentially completely around the drum top to form with said top a liquid impermeable cavity capable of holding a liquid, means forming an opening in said top for dispensing the contents of said drum, said opening means being sealed to prevent any liquid collecting in said cavity from entering said drum, a wick material having two ends, one said end contacting the drum top, the wick material extending over the rim and downwardly from the rim to a point below the level of the drum top to terminate at the other said end, the wick material having the physical property of conducting liquid in contact therewith in the cavity by capillary action through the wick material, upwardly over the rim and subsequently downwardly to said other end of the wick where it drips from the wick material, means for securing said wick material to said drum in a position to contact liquid collecting on the drum top.

2. The combination of claim 1 wherein the wick material is adhesively bonded to the top.

3. The combination of claim 1 wherein the wick material is sandwiched between a deformable layer and the drum top.

4. The combination of claim 1 wherein the wick material sandwiches a deformable member between it and the drum top.

5. The combination of claim 3 wherein the deformable layer is twenty gage galvanized steel.

6. The combination of claim 5 wherein the wick material is sixteen ounce filter felt.

7. The combination of claim 5 wherein the wick material is cotton corduroy cloth.

8. The combination of claim 5 wherein the wick material is paper towel material.

9. The combination of claim 1 wherein the wick material magnetically secured to the drum.

10. The combination of claim 5 wherein the deformable layer is thin aluminum.

11. The combination of claim 1 wherein the wick material is a 50—50% blend of acrylic and cotton fibers.

12. The combination of claim 1 wherein the wick material is sandwiched between two layers of deformable material.

13. The combination of claim 3 wherein the deformable layer is perforated to facilitate drying of the wick.

14. The combination of claim 13 wherein the deformable layer includes a black surface facing away from the wick.

15. The combination of claim 3 wherein the deformable layer comprises a double sided adhesive tape.

16. The combination of claim 1 wherein the wick material is 7.5 ounce per square yard non-woven rayon.

17. The combination of claim 1 wherein the means securing the wick material to the drum top comprises an adhesive.

18. The combination of claim 17 including an adhesive layer securing the wick material to the sidewall of the drum.

19. The combination of claim 18 wherein the adhesive layer extends from the drum top, over the rim and down the sidewall of the drum.

20. The combination of claim 18 wherein the adhesive layer comprises at least one spot of adhesive contacting the drum top and at least one spot of adhesive contacting the drum sidewall.

* * * * *